US005797625A

United States Patent [19]

Giulie

[11] Patent Number: 5,797,625

[45] Date of Patent: Aug. 25, 1998

[54] CORNER BIND APPARATUS WITH ANTI-TEAR FEATURE

[76] Inventor: Joe D. Giulie, 924 Chevy Way, Medford, Oreg. 97504

[21] Appl. No.: 702,108

[22] Filed: Aug. 23, 1996

Related U.S. Application Data

[63] Continuation-in-part of Ser. No. 232,715, Apr. 25, 1994, Pat. No. 5,570,906.

[51] Int. Cl.[6] ..... B42D 1/106

[52] U.S. Cl. ..... 281/42; 281/21.1; 281/28

[58] Field of Search ..... 281/20, 21.1, 28, 281/45, 27.3, 42; 116/234–239; 462/71; 40/159.1, 662, 663, 665, 666; 24/67 CF

[56] References Cited

U.S. PATENT DOCUMENTS 5,570,906 11/1996 Guilie ..... 281/42

*Primary Examiner*—Frances Han

*Attorney, Agent, or Firm*—Bruce H. Johnsonbaugh

[57] ABSTRACT

A corner bind apparatus is provided for binding together a plurality of sheets at an aligned corner. An anti-shear mechanism such as a staple is provided to keep the sheets from sliding relative to each other, for use in combination with an anti-peel device which wraps around the corner of the plurality of sheets to resist the top sheets from being lifted off of the stack of sheets, for use in combination with an anti-tear device which resists tearing of the top sheet or sheets along the edge of the corner bind device.

9 Claims, 3 Drawing Sheets

CORNER BIND APPARATUS WITH ANTI-TEAR FEATURE

CROSS-REFERENCE TO RELATED APPLICATION

This application is a continuation-in-part of application Ser. No. 08/232,715 filed Apr. 25, 1994 now U.S. Pat. No. 5,570,906 and entitled CORNER BIND APPARATUS AND METHOD.

BACKGROUND AND BRIEF SUMMARY OF THE INVENTION

The present invention relates to an improvement over the invention claimed in application Ser. No. 08/232,715. That invention relates to a corner bind apparatus which prevents a stack of sheets from sliding relative to each other and also provides an anti-peel feature to prevent sheets being lifted off the remainder of the sheets. The present improvement provides an anti-tear feature which makes it more difficult to tear the top sheet or sheets along the edge of the corner bind apparatus.

A primary object of the present invention is to provide a corner bind apparatus which provides resistance to shear, peel and tearing of the top sheet or sheets against a side of the corner bind apparatus.

Further objects and advantages of the invention will become apparent from the following description and the drawings wherein:

DETAILED DESCRIPTION OF THE DRAWINGS

As described above, the present invention constitutes an improvement to the invention shown and claimed in Ser. No. 08/232,715, which prior application is hereby incorporated by reference as if set forth in full herein.

Referring to FIGS. 1–4 herein, a plurality of sheets 10 is shown having one corner 11 of each sheet aligned with each of the other sheets.

Figure 1:
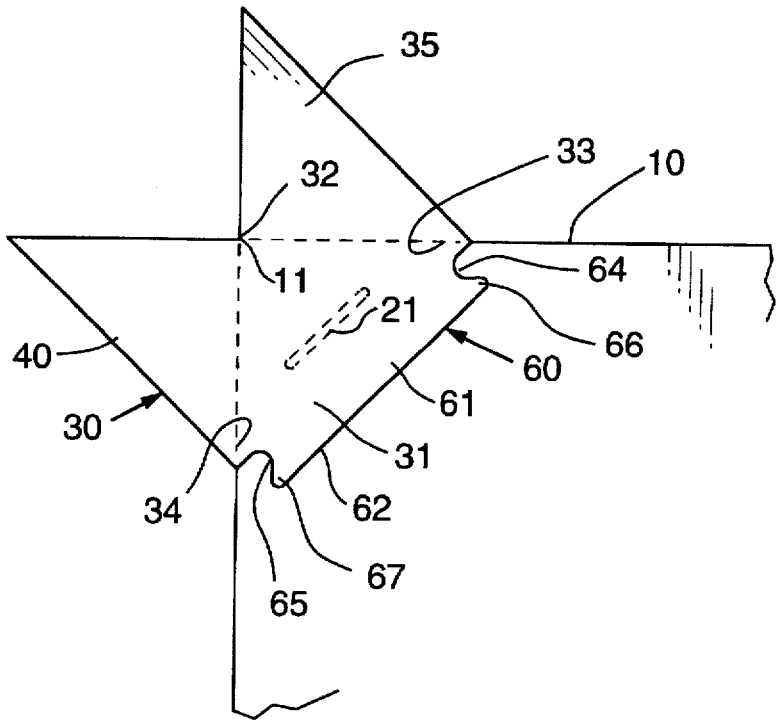
FIG. 1 is a plan view of one embodiment of the invention shown in the process of being attached to an aligned corner of a plurality of sheets.

In FIG. 1, staple 21 forms the anti-shear means and has been applied through the plurality of sheets 10 before the corner bind apparatus has been placed in position. For the sake of clarity, the staple 21 or other anti-shear means that may be used in this invention are not shown in FIGS. 2–4.

Referring to FIG. 1, the anti-peel means comprises a planar body 31, a first tab 35 and a second tab 40. The underside of the body 31 and tabs 35 and 40 have an adhesive applied thereto so that the corner bind apparatus, when in place, surrounds and grips the aligned corner 11 when tabs 35 and 40 are folded around on the back side of sheets 10. According to the present invention, an anti-tear means shown generally as 60 is provided which is connected to the body portion 31 of the anti-peel means 30. The anti-tear means 60 as shown in FIG. 1 comprises an extension 61 of body 31. Body 31 forms a right triangle having a right angle 32 which overlies the aligned corner 11 of sheets 10. Triangular body 31 also has two acute angles 33 and 34. The diagonal edge 62 of extension 61 is connected to the acute angles 33 and 34 by a generally S-shaped curve 64 and a generally reverse S-shaped curve 65. Extension 61 has a pair of arms 66 and 67 which are formed adjacent the recesses described by the S-shaped curve 64 and the reverse S-shaped curve 65, respectively. The purpose of the anti-tear means 60 is to resist tearing of one or more of the top sheets of the plurality of sheets 10 along the edge of the corner bind apparatus.

As a practical matter, as the user lifts the top sheet, the arms 66 and 67 will resist tearing of the top sheet which would otherwise occur at acute angles 33 and 34. Use of the anti-tear means as shown significantly increases the amount of force that must be applied to tear the top sheet away from the corner bind apparatus.

Figure 2:
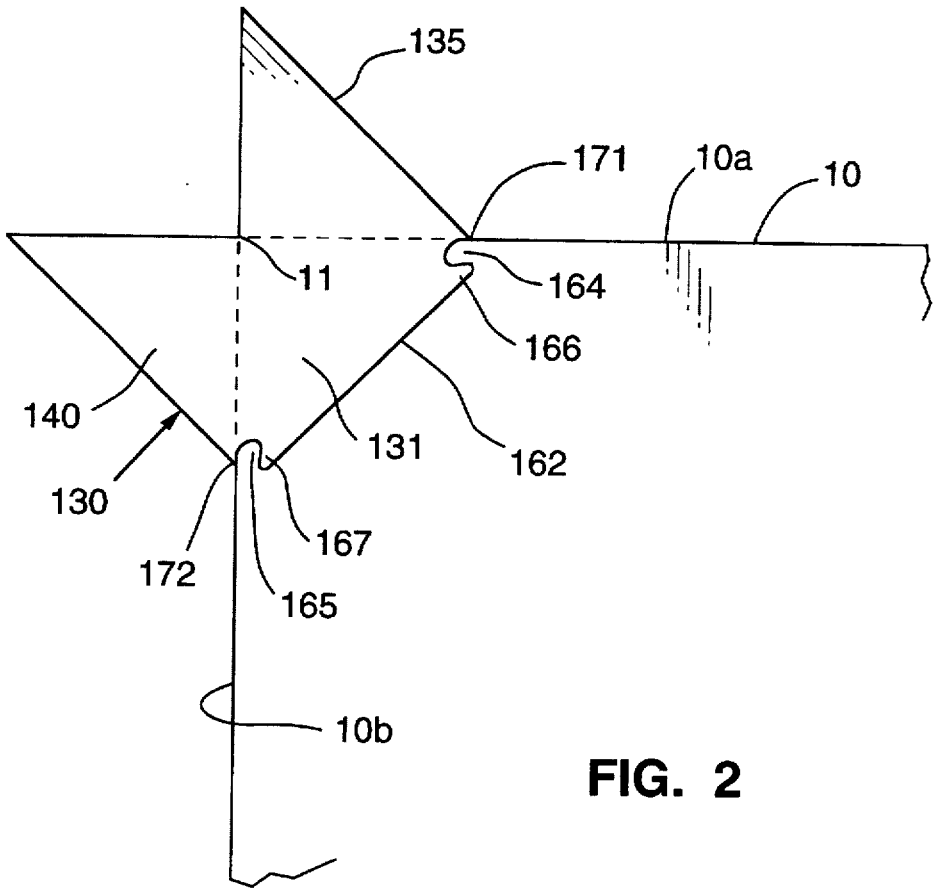
FIG. 2 is a plan view of another embodiment of the invention in the process of being applied to an aligned corner of a plurality of sheets.

The embodiment shown in FIG. 2 includes a body portion 131 of the anti-peel means and two triangular tabs 135 and 140. The inside edge 162 of body 131 lies on an imaginary line which connects points 171 and 172 which are the points where the edges of the tabs 135 and 140 of anti-peel means 130 intersect the upper edge 10*a* of said plurality of sheets and the side edge 10*b*, respectively. The design shown in FIG. 2 does not provide as much resistance to tear as the embodiment shown in FIG. 1. However, the embodiment shown in FIG. 2 has the advantage that the anti-tear means is formed within the outline of the anti-peel means 130 and an extension, similar to the extension 61 shown in FIG. 1, of the body is not required.

Figure 3:
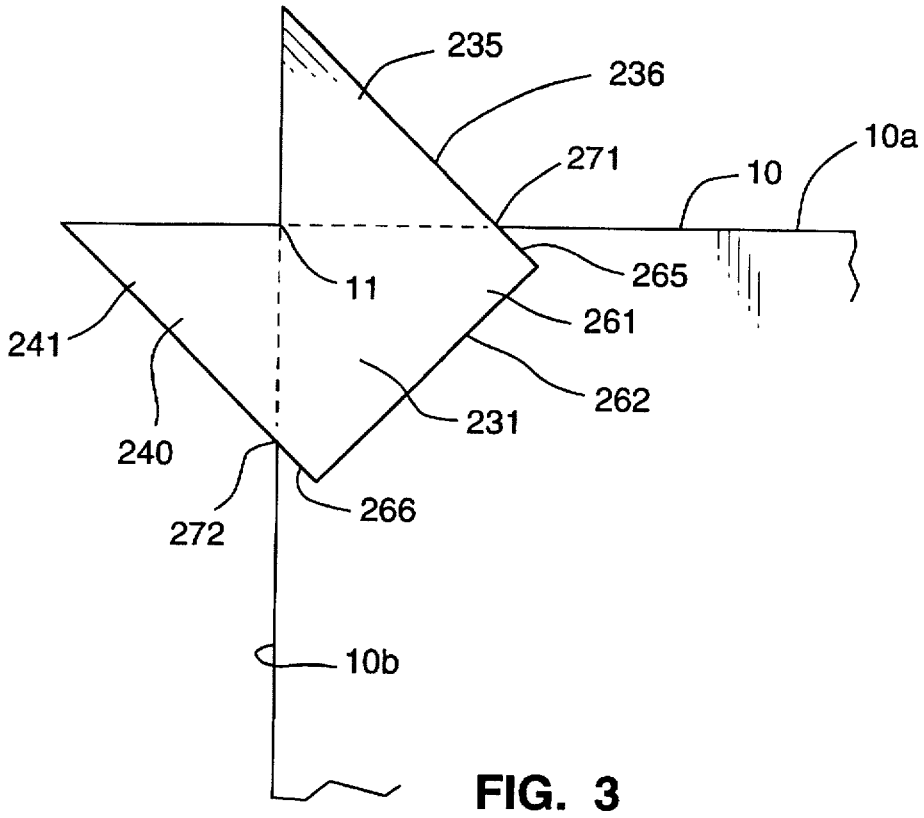
FIG. 3 is a plan view of a third embodiment of the invention in the process of being applied to an aligned corner of a plurality of sheets.

FIG. 3 shows a third embodiment of the invention having a triangular body 231, triangular tabs 235 and 240 and a rectangular extension 261 which extends away from the aligned corner 11, past the imaginary line connecting points 271 and 272, which are points located at the intersection of the outer edges 236 and 241 of tabs 235 and 240, respectively, with the upper edges 10*a* and side edge 10*b* of the plurality of sheets 10. Extension 261 has an inside edge 262 further away from the aligned corner 11 than the imaginary line between points 271 and 272. In operation, as the user lifts upwardly on the top sheet of sheets, resistance to tear is increased by the presence of extension 261. If the user lifts upwardly on the side edge 10*b* of the top sheet, resistance to tear is provided by the edge 266 of extension 261.

Figure 4:
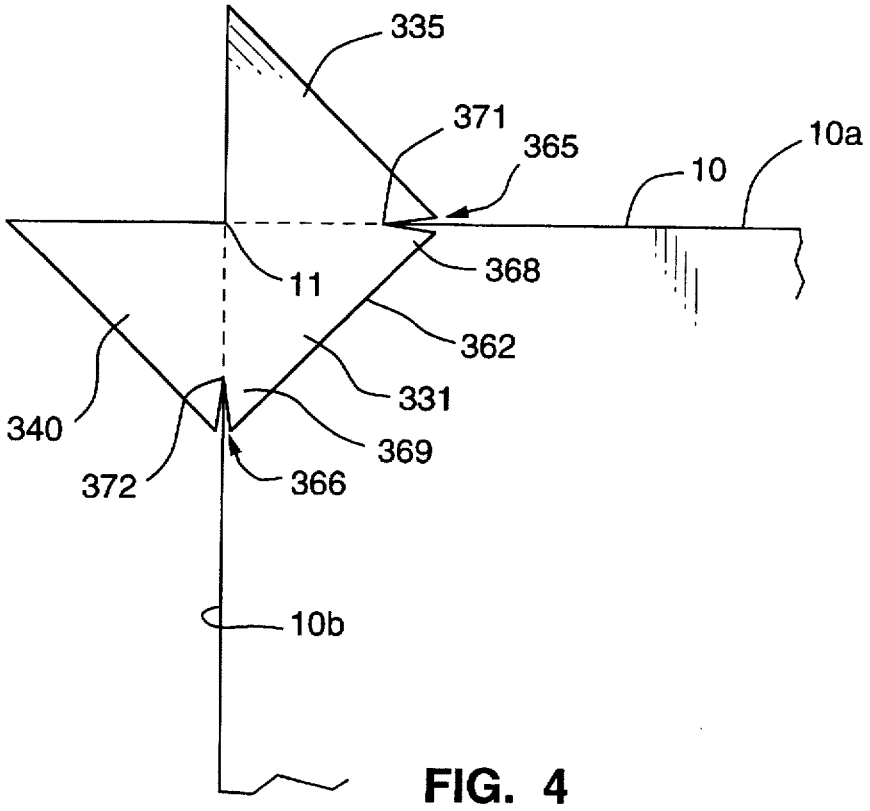
FIG. 4 is a plan view of a fourth embodiment of the invention in the process of being applied to an aligned corner of a plurality of sheets.

FIG. 4 shows a fourth embodiment having a triangular body 331, triangular tabs 335 and 340 and wherein simple slits 365 and 366 have been cut along a line between the body 331 and tabs 335 and 340, which lines also correspond to those formed by the top edge 10*a* of the plurality of sheets and side edge 10*b* of said plurality of sheets. The triangular arms 368 and 369 formed in the body 331, as the slits 365 and 366 are made, offer resistance to tear. As the top sheet is lifted, either arm 368 or 369 will offer increased resistance to tear by flexing slightly in an upward direction. The "tear point" is thereby moved towards the apexes 371 and 372 of slits 365 and 366 at which point considerably more upward force must be applied to tear off the top sheet by either overcoming the resistance of arm 368 or 369 and tearing along the inside diagonal edge 362 or by increasing the depth of either slit 365 or 366 by tearing the corner bind apparatus, itself.

Figure 5:
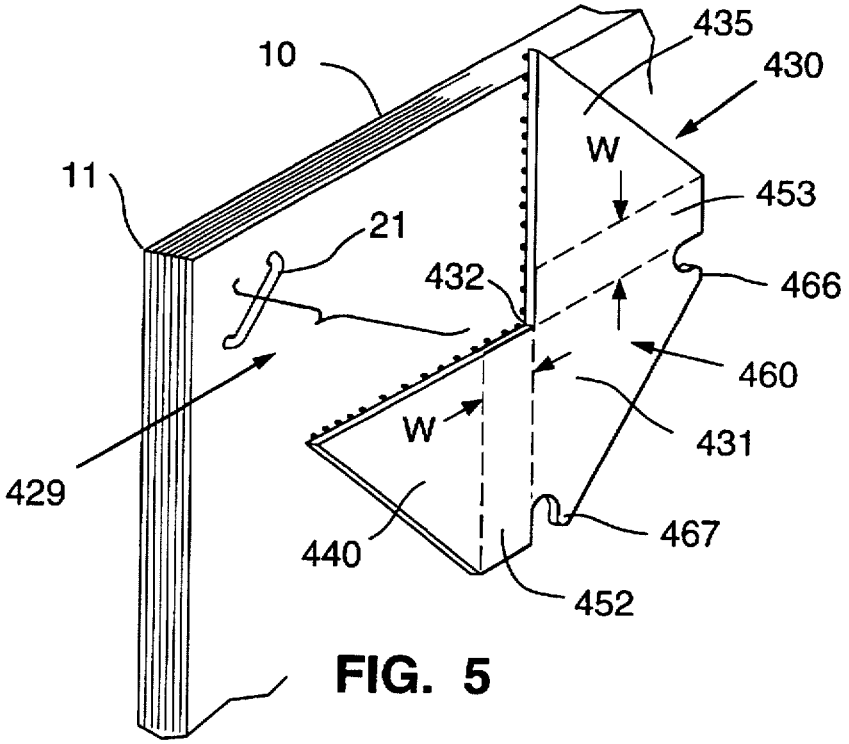
FIG. 5 is a perspective view showing a fifth embodiment of the invention as the anti-peel portion of the apparatus is about to be applied.
Figure 6:
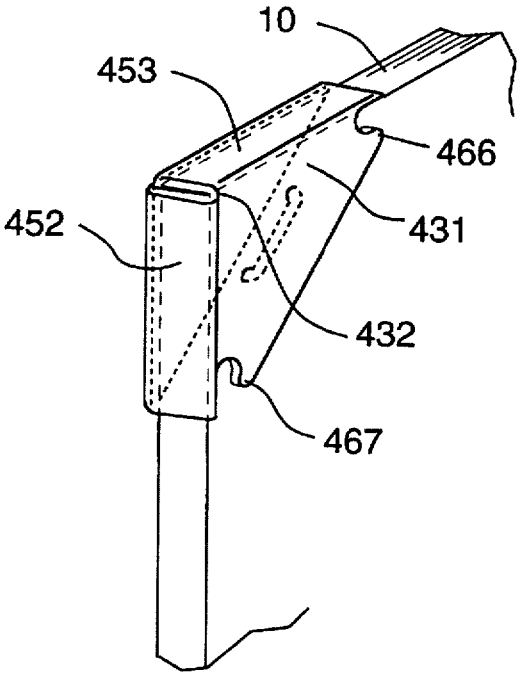
FIG. 6 is a perspective view of the device of FIG. 5 with the corner bind apparatus after it has been applied.

FIGS. 5 and 6 show a fifth embodiment of the present invention for use with a plurality of sheets 10 wherein the number of sheets has a considerable thickness, i.e., one-eighth inch or greater. In this embodiment, the anti-peel means 430 has a pair of rectangular spacing regions 452 and 453 formed between the body 431 and tabs 435 and 440, respectively. Rectangular spacing regions 452 and 453 have a width "W" which is approximately the same as the thickness of the plurality of sheets 10, so that when the tabs 435 and 440 are folded around onto the backside of the plurality of sheets, as shown in FIG. 6, rectangular spacing regions 452 and 453 lie against the sides of the sheets 10 and the tabs 435 and 440 overlap each other neatly on the backside of the sheets 10. FIG. 5 shows the anti-peel means 430 shown a distance away from the corner 11 represented by the bracket 429.

It is understood that each of the embodiments shown in FIGS. 1–4 can be readily modified to have rectangular spacing regions 452 and 453 formed between the body portion and the tabs to account for various thicknesses of the plurality of sheets 10. As shown in FIGS. 1–4, the embodiments are shown without the rectangular spacing regions 452 and 453 for use on a relatively small number of sheets 10 which are being bound together at their corner 11.

What is claimed is:

1. A corner bind apparatus for binding together a plurality of sheets, said sheets having front and back surfaces, side edges and wherein said sheets have one corner aligned with each other, comprising:

anti-shear means for application to the aligned corner region of each sheet to prevent said sheets from sliding relative to each other, anti-peel means for application to the aligned corner after application of said anti-shear means, said anti-peel means being adapted to extend fully around and grip the aligned corner to resist said sheets separating by at least one sheet being lifted off the remaining sheets, wherein said anti-peel means comprises a planar body and first and second planar tabs connected to said body, said body and said first and second tabs having upper and lower surfaces and wherein said body is adapted to be applied to said front side of said plurality of sheets at said aligned corner and said first and second tabs are adapted to extend around the back side of said aligned corner whereby said first tab overlaps said second tab on said back side of said aligned corner, anti-tear means for increasing resistance to tearing of said sheets along a side of said body, and adhesive means carried by said lower surfaces of both of said tabs and said body so that said body and both tabs will adhere to and form a continuous surface around said aligned corner.

2. The apparatus of claim 1 wherein said anti-tear means comprises two recesses formed in said body, said recesses being formed adjacent two points where said body intersects said side edges of said sheets.

3. The apparatus of claim 2 wherein said recesses are curved.

4. The apparatus of claim 2 wherein said anti-tear means further comprises an extension of said body with at least one arm formed adjacent said recess, said arm adapted to further increase resistance to peel.

5. The apparatus of claim 1 wherein said anti-tear means comprises a rectangular extension of said body.

6. The apparatus of claim 1 wherein said body is generally right triangular in shape having one right angle and two acute angles and wherein said anti-tear means comprises one generally S-shaped edge and one generally reverse S-shaped edge formed in said body at said two acute angles.

7. The apparatus of claim 1 further comprising rectangular spacing regions provided between said body and said first and second tabs.

8. A corner bind apparatus for binding together a plurality of sheets wherein said sheets have one corner aligned with each other and wherein said plurality of sheets has a front surface, a back surface and side edges comprising:

a staple adapted to extend through said plurality of sheets near said aligned corner, said staple having first and second exposed ends on said front and back surfaces of said plurality of sheets, a planar binder means with top and bottom surfaces having a triangular shaped body and first and second tabs extending outwardly from said body, adhesive means carried on said bottom surface of said triangular body and said tabs, said body is adapted to be placed over said first exposed end of said staple and to adhere to said front surface of said aligned corner of said sheets, anti-tear means connected to said body, said anti-tear means being adapted to increase resistance to tearing of said sheets along a side of said body, and said tabs are adapted to be folded around said aligned corner, against said edges of said sheets, onto the back side of said plurality of sheets to cover said second exposed end of said staple and to overlap each other and to adhere to said back surface of said aligned corner, whereby said corner bind apparatus forms a continuous surface which extends around and adheres to said front, back and edges of said aligned corner of said plurality of sheets.

9. The apparatus of claim 8 further comprising rectangular spacing regions provided between said body and said first and second tabs.

* * * * *

UNITED STATES PATENT AND TRADEMARK OFFICE

CERTIFICATE OF CORRECTION

PATENT NO. : 5,797,625

DATED : August 25 , 1998

INVENTOR(S) : Joe D. Giulie

It is certified that error appears in the above-identified patent and that said Letters Patent is hereby corrected as shown below:

The following Notice should appear on the cover sheet of the patent:

"The term of this patent shall not extend beyond the expiration date of Pat. No. 5,570,906."

Signed and Sealed this

Seventeenth Day of November, 1998

*Attest:*

*Attesting Officer*

Bruce Lehman

BRUCE LEHMAN

*Commissioner of Patents and Trademarks*